US009404292B2

(12) United States Patent
Da Deppo et al.

(10) Patent No.: US 9,404,292 B2
(45) Date of Patent: Aug. 2, 2016

(54) VEHICULAR DOOR HANDLE ASSEMBLY WITH DEPLOYABLE LATCH CONNECTION

(71) Applicant: Huf North America Automotive Parts Mfg. Corp., Milwaukee, WI (US)

(72) Inventors: Lynn D. Da Deppo, Bloomfield Hills, MI (US); Ehab Kamal, Novi, MI (US); David Newkirk, West Bloomfield, MI (US)

(73) Assignee: HUF NORTH AMERICA AUTOMOTIVE PARTS MFG. CORP., Milwaukee, WI (US)

( * ) Notice: Subject to any disclaimer, the term of this patent is extended or adjusted under 35 U.S.C. 154(b) by 472 days.

(21) Appl. No.: 13/828,261

(22) Filed: Mar. 14, 2013

(65) Prior Publication Data

US 2014/0015262 A1 Jan. 16, 2014

Related U.S. Application Data

(60) Provisional application No. 61/670,466, filed on Jul. 11, 2012.

(51) Int. Cl.

| | |
|---|---|
| ***E05B 3/00*** | (2006.01) |
| ***E05B 77/06*** | (2014.01) |
| ***E05B 85/16*** | (2014.01) |
| ***E05B 77/04*** | (2014.01) |
| ***E05B 13/00*** | (2006.01) |

(52) U.S. Cl.

CPC ..... *E05B 77/06* (2013.01); *E05B 13/005* (2013.01); *E05B 77/04* (2013.01); *E05B 85/16* (2013.01); *Y10T 292/57* (2015.04)

(58) Field of Classification Search

CPC ..... Y10T 16/458; Y10T 292/57; E05B 77/06
USPC ..... 292/336.3, DIG. 22, DIG. 65, DIG. 63; 16/110.1

See application file for complete search history.

(56) References Cited

U.S. PATENT DOCUMENTS

| | | | | | |
|---|---|---|---|---|---|
| 2,029,197 | A | * | 1/1936 | Roedding | 292/221 |
| 2,485,000 | A | * | 10/1949 | Jakeway | 292/167 |
| 3,020,075 | A | * | 2/1962 | Johnstone et al. | 292/336.3 |
| 3,159,415 | A | * | 12/1964 | Sandor | 292/336.3 |
| 3,858,921 | A | * | 1/1975 | Kuki | 292/336.3 |
| 4,475,754 | A | * | 10/1984 | Arlauskas et al. | 292/336.3 |
| 4,482,179 | A | * | 11/1984 | Johnson | 292/336.3 |
| 4,895,403 | A | * | 1/1990 | Osenkowski | 292/336.3 |

(Continued)

FOREIGN PATENT DOCUMENTS

| | | | | |
|---|---|---|---|---|
| DE | 3500550 | A1 * | 10/1985 | E05B 65/20 |
| EP | 1586726 | A1 * | 10/2005 | E05B 65/20 |

(Continued)

*Primary Examiner* — Carlos Lugo
*Assistant Examiner* — Faria Ahmad
(74) *Attorney, Agent, or Firm* — Honigman Miller Schwartz and Cohn LLP; Matthew H. Szalach; Jonathan P. O'Brien

(57) ABSTRACT

When activated, a handle assembly selectively allows the door latch of a door of a motor vehicle to be released. The handle assembly includes a base fixedly secured to the door and a handle assembly which in its passive state has minimal to no presence in the opening chain of the door latch. The handle assembly includes a handle strap with a handle grip or activation lever which allows completion of the force chain to the latch, thus selectively allowing desired door opening.

17 Claims, 9 Drawing Sheets

(56) References Cited

U.S. PATENT DOCUMENTS

| | | | | |
|---|---|---|---|---|
| 5,123,687 | A * | 6/1992 | Pfeiffer et al. | 292/336.3 |
| 5,421,061 | A * | 6/1995 | Kolle et al. | 292/336.3 |
| 5,860,684 | A * | 1/1999 | Mizuki | 292/336.3 |
| 5,887,918 | A * | 3/1999 | Okada et al. | 292/336.3 |
| 5,975,597 | A * | 11/1999 | Makiuchi et al. | 292/336.3 |
| 6,007,122 | A * | 12/1999 | Linder et al. | 292/336.3 |
| 7,097,216 | B2 * | 8/2006 | Lane et al. | 292/216 |
| 7,217,899 | B2 * | 5/2007 | Hidaka et al. | 200/600 |
| 7,437,803 | B2 * | 10/2008 | Watanabe et al. | 16/412 |
| 7,635,151 | B2 * | 12/2009 | Rodawold et al. | 292/336.3 |
| 7,677,614 | B2 * | 3/2010 | Monig | 292/336.3 |
| 8,424,936 | B2 * | 4/2013 | Muller et al. | 292/336.3 |
| 9,062,477 | B2 * | 6/2015 | Da Deppo et al. | |
| 2002/0046440 | A1 * | 4/2002 | Agostini et al. | 16/110.1 |
| 2002/0059693 | A1 * | 5/2002 | Jooss et al. | 16/412 |
| 2004/0217601 | A1 * | 11/2004 | Garnault et al. | 292/336.3 |
| 2005/0161959 | A1 * | 7/2005 | Belchine, III | 292/336.3 |
| 2005/0212308 | A1 * | 9/2005 | Makino et al. | 292/336.3 |
| 2005/0236846 | A1 * | 10/2005 | Hidaka et al. | 292/216 |
| 2006/0038417 | A1 * | 2/2006 | Pudney | 292/336.3 |
| 2006/0038418 | A1 * | 2/2006 | Huizenga et al. | 292/336.3 |
| 2006/0091680 | A1 * | 5/2006 | Cummins et al. | 292/336.3 |
| 2007/0046080 | A1 * | 3/2007 | Muneta | 297/184.13 |
| 2007/0069533 | A1 * | 3/2007 | Cummins et al. | 292/336.3 |
| 2007/0294861 | A1 * | 12/2007 | Cummins et al. | 16/412 |
| 2008/0028885 | A1 * | 2/2008 | Monig | 74/523 |
| 2008/0036219 | A1 * | 2/2008 | Savant et al. | 292/336.3 |
| 2009/0026774 | A1 * | 1/2009 | Watanabe et al. | 292/336.3 |
| 2009/0279826 | A1 * | 11/2009 | Ieda et al. | 385/13 |
| 2009/0302620 | A1 * | 12/2009 | Muller et al. | 292/336.3 |
| 2010/0088855 | A1 * | 4/2010 | Ruse et al. | 16/412 |
| 2010/0127516 | A1 * | 5/2010 | Fannon | 292/336.3 |
| 2010/0230980 | A1 * | 9/2010 | Ichikawa et al. | 292/336.3 |
| 2011/0115240 | A1 * | 5/2011 | Muller et al. | 292/336.3 |
| 2011/0163554 | A1 * | 7/2011 | Patel | 292/216 |
| 2011/0204662 | A1 * | 8/2011 | Savant et al. | 292/336.3 |
| 2012/0280520 | A1 * | 11/2012 | Wellborn et al. | 292/336.3 |
| 2013/0187394 | A1 * | 7/2013 | Lesueur et al. | 292/336.3 |
| 2013/0221690 | A1 * | 8/2013 | Rocci et al. | 292/336.3 |
| 2013/0233034 | A1 * | 9/2013 | Ono et al. | 70/101 |
| 2014/0049058 | A1 * | 2/2014 | Kudoh et al. | 292/336.3 |
| 2014/0117683 | A1 * | 5/2014 | Saitou | 292/336.3 |
| 2014/0145454 | A1 * | 5/2014 | Da Deppo et al. | 292/336.3 |
| 2014/0203574 | A1 * | 7/2014 | Noda et al. | 292/336.3 |
| 2014/0239650 | A1 * | 8/2014 | Kato | 292/336.3 |
| 2014/0292005 | A1 * | 10/2014 | Bendel et al. | 292/336.3 |
| 2014/0375069 | A1 * | 12/2014 | Niegeloh et al. | 292/336.3 |
| 2015/0091311 | A1 * | 4/2015 | Witte et al. | 292/336.3 |
| 2015/0123410 | A1 * | 5/2015 | Kang et al. | 292/336.3 |

FOREIGN PATENT DOCUMENTS

| | | | | |
|---|---|---|---|---|
| EP | 1950366 | B1 | 7/2008 | |
| FR | EP 1586726 | A1 * | 10/2005 | E05B 77/02 |
| IT | EP 1950366 | A2 * | 7/2008 | E05B 77/04 |

* cited by examiner

VEHICULAR DOOR HANDLE ASSEMBLY WITH DEPLOYABLE LATCH CONNECTION

CROSS-REFERENCE TO RELATED APPLICATIONS

This application claims the benefit of U.S. provisional patent application Ser. No. 61/670,466 filed on Jul. 11, 2012, the contents of which are incorporated by reference for all purposes as if set forth in their entirety herein.

STATEMENT OF FEDERALLY SPONSORED RESEARCH OR DEVELOPMENT

Not applicable.

BACKGROUND

This disclosure relates to a handle assembly for a motor vehicle door. More particularly, it relates to a handle assembly having a selectively deployable connection which reduces the likelihood of the unintended opening of the door during a crash event.

Conventionally, motor vehicles include at least one outside door handle for releasing a door latch mechanism in order to open a door. Typically, a user actuates the outside door handle by pulling a handle strap relative to a fixed base. This causes the release of a door latch which, in turn, permits the door to swing open.

The handle strap may, however, also be activated when the outside door handle experiences a high inertia force. The movement of the handle strap relative to the base in response to the high inertia force can cause inadvertent unlatching and resultant opening of the door.

In recent years, there has been development of locking mechanisms to attempt to prevent the opening of a vehicular door in the event of such a high inertia force. While these mechanisms work for some crash situations, high acceleration impact or vehicle rollover may result in forces that overcome these locking devices.

Accordingly, there is a continued need for handle assemblies that are not susceptible to the effects of high inertial forces such as those imposed during a vehicular crash.

SUMMARY OF THE INVENTION

A handle assembly is disclosed that has a structure that decouples the effect of inertial forces on the handle strap from the door unlatching system. The disclosed handle assembly requires that in order to release the door latch, a handle grip be actuated before the handle strap is pulled or otherwise actuated. The actuation of the handle grip effectuates the engagement of a pawl with a latch cable release cam so as to operate the release cam. However, if the handle grip is not actuated, then the pawl rotates past the release cam and the door latch is not released.

This means that, as long as any inertial forces induced by a crash event cause the handle strap to be actuated before any actuation of the handle grip, that the door latch mechanism will not be operated.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENTS

Referring first to FIGS. 1A, 1B, 2A, and 2B, one embodiment of a handle assembly 10 according to the present invention is shown disposed on a motor vehicle door 12.

Figure 1A:
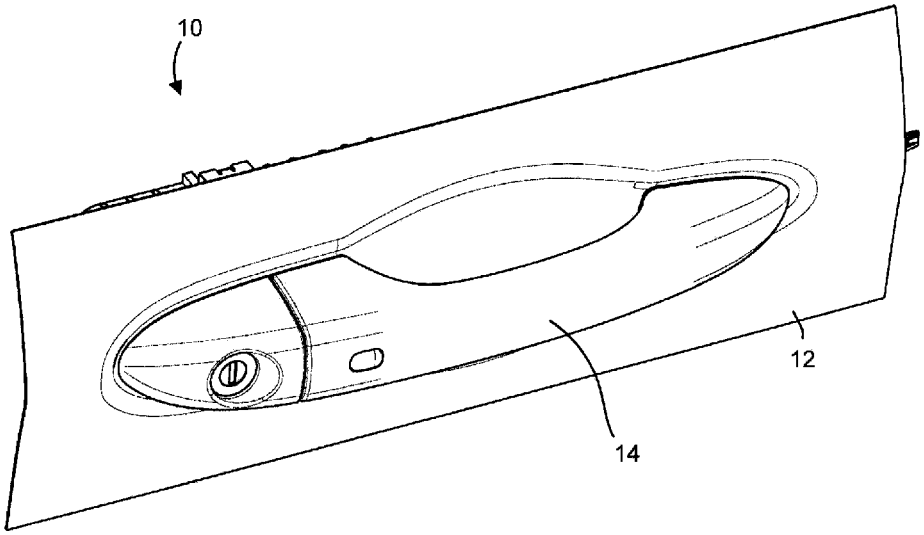
FIGS. 1A and 1B are views of a handle assembly in a vehicle door in which the handle is not engaged or operated.
Figure 1B:
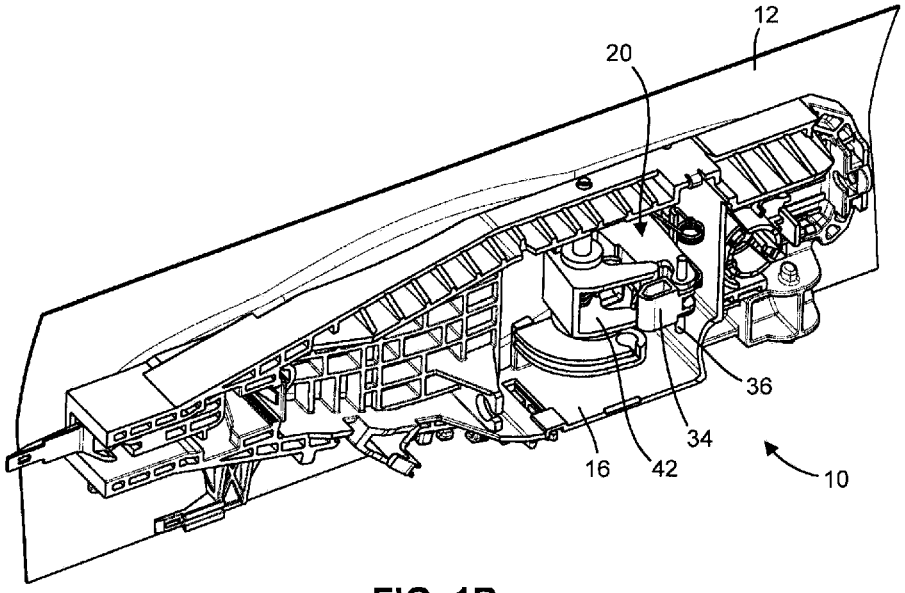

In FIG. 1A, the handle strap 14 of the handle assembly 10 is shown in the closed position on the front side of the door 12. FIG. 1B illustrates the rear side of handle assembly 10 (which is inside the door 12) when the handle strap 14 is closed (i.e., not actuated, pulled, or otherwise moved) and the arrangement of the various parts which will be described in further detail below. In this position of the handle strap 14, the door latch is not released which means that if the door 12 is closed, then the door 12 is prevented from swinging away from the car body or that, if the door 12 is originally open and then closed, that after closing the door 12 will be prevented from swinging away from the body of the car.

Figure 2A:
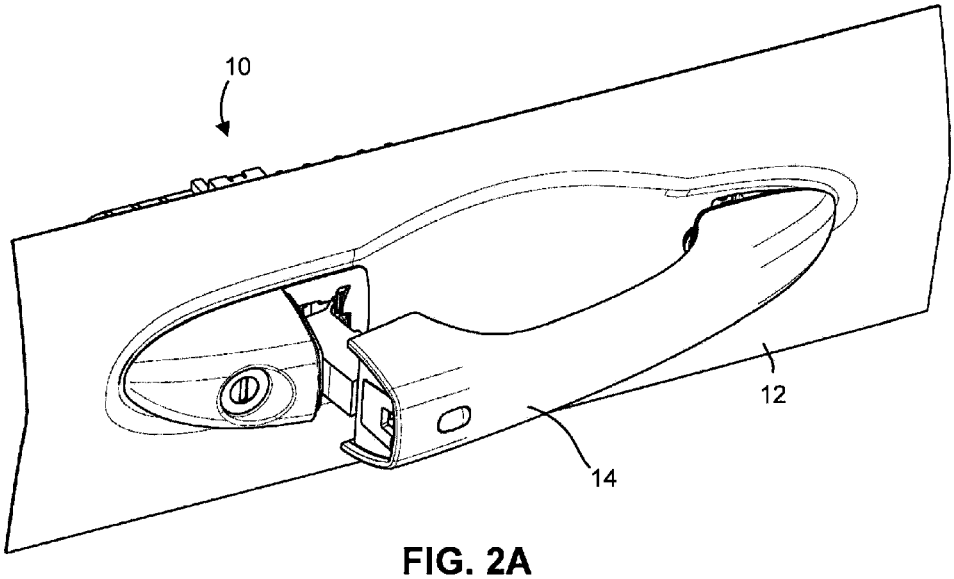
FIGS. 2A and 2B are views of the handle assembly in FIGS. 1A and 1B in which a handle grip or actuation pad has been depressed and the handle pulled.
Figure 2B:
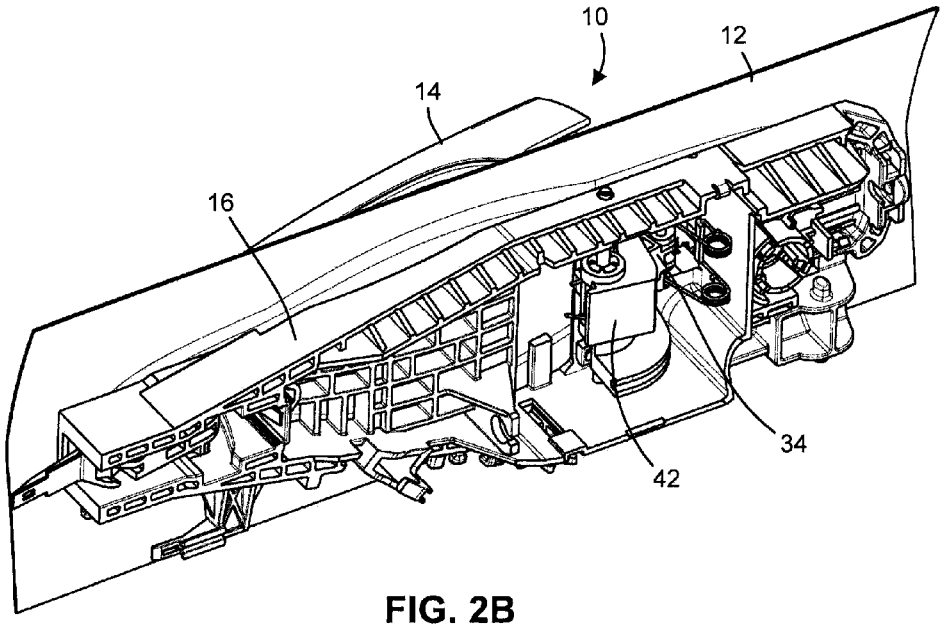
Figure 3A:
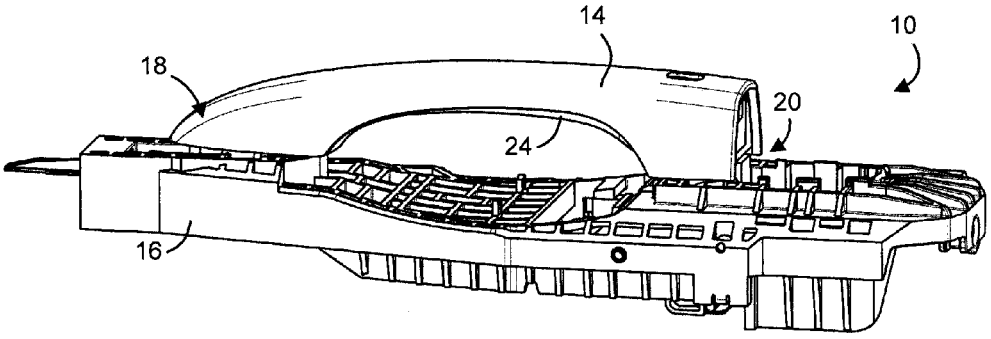
FIG. 3A is a portion of the handle assembly apart from the door.
Figure 3B:
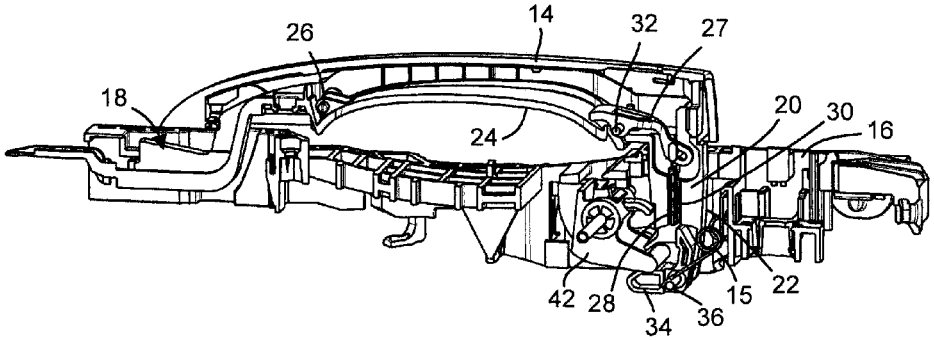
FIG. 3B is a partial cross-sectional view of the handle assembly of FIG. 3A.
Figure 3C:
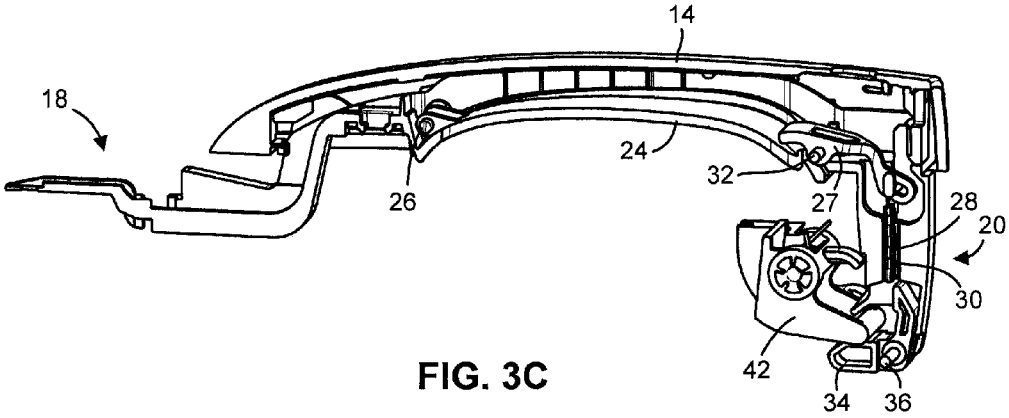
FIG. 3C is the handle assembly of FIG. 3B in which the base is removed to better highlight some of the internal components of the handle assembly.
Figure 4A:
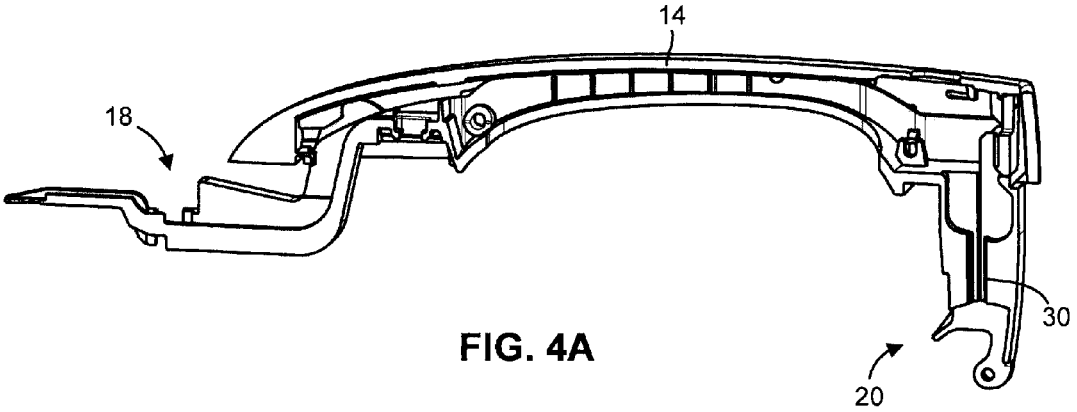
FIGS. 4A through 4F separately illustrate some of the components of the handle assembly.
Figure 4B:
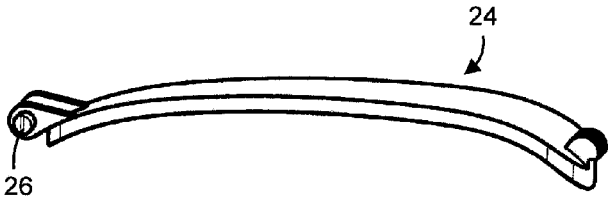
Figure 4C:
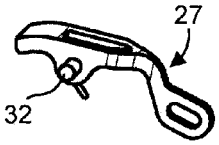
Figure 4D:
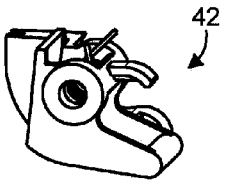
Figure 4E:
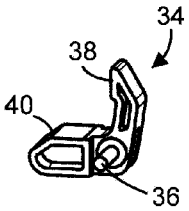
Figure 4F:
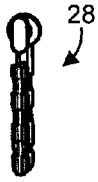

In FIG. 2A, the handle strap 14 of the handle assembly 10 is shown in the open position in which the handle strap 14 has been pulled or actuated away from the door 12. Additionally, although it cannot be seen in this view, the handle grip 24 has been actuated or depressed prior to the movement of the handle strap 14. FIG. 2B illustrates the rear side of the handle assembly 10, when the handle strap 14 and the handle grip have been actuated. By moving the handle strap 14 to the position in FIGS. 2A and 2B and actuating the handle grip, the door latch can be released to permit the opening of the door 12. The handle strap 14 is biased to the closed position of FIGS. 1A and 1B using a spring 15 such as is illustrated in FIGS. 5A through 5C and 6A through 6C.

Now with additional reference to FIGS. 3A through 3C and 4A through 4E, the various parts of the handle assembly 10 are illustrated.

As best seen in FIGS. 1B, 2B, 3A, and 3B, the handle assembly 10 includes a base 16 which is fixed to the door 10. A base end 18 of the handle strap 14 is pivotally fixed to one end of the base 16 while a handle end 20 can extend at least part way through an opening 22 proximate the other end of the base 18. As noted above, the base 16 and handle strap 14 are configured such that the handle strap 14 is generally biased to the closed position illustrated in FIGS. 1A and 1B, but this biasing force may be overcome when the handle strap 14 is pulled away from the base 16.

Returning to the handle strap 14, it can be seen that the side of the handle strap 14 facing the door 12 includes a handle grip 24 or user-actuatable pad. In the form illustrated, one end of this handle grip 24 is pivotally connected to the handle strap 14 about a pin/axis 26 proximate the base end 18 of the handle strap 14. On the other end of the handle grip 24, which is closer to the handle end 20 of the handle strap 14, the handle grip 24 is connected to a linking member 27. This linking member 27 connects to a leg 28 or blocking link.

The leg 28 extends through an opening 30 that extends through the handle end 20 of the handle strap 14. On one end of the leg 28, the leg 28 is connected to the linking member 27 which is, in turn, connected to the free end (i.e., not pivotally fixed end) of the handle grip 24. The connection of the leg 28 to the linking member 27 occurs on the side of the opening 30 which is closest to the outside of the door 12. On the other side of the opening 30 (which faces the inside of the door 12), a free end of the leg 28 is situated. This free end may either be positioned in the opening 30 or project some distance out from the opening 30.

Based on the arrangement of the handle strap 14, the handle grip 24, the linking member 27, and the leg 28, the actuation of the handle grip 24 relative to and toward the handle strap 14 (for example, by squeezing the handle grip 24 into the handle strap 14) can cause the linking member 27 to rotate about a pivot point 32. This rotation of the linking member 27 causes the leg 28 attached to the linking member 27 to move out of the opening 30 of the handle end 20 of the handle strap 14 (or to move further out of the opening 30, depending on the original position of the leg 28).

It should be noted that typically this arrangement of the handle strap 14, the handle grip 24, the linking member 27, and the leg 28, can be biased to the position in which the leg 28 is retracted and the handle grip 24 is moved away from the handle strap 14. This could be done in a number of ways including, for example, biasing the handle grip 14 and/or the linking member 27 using a spring, although other biasing mechanisms could be utilized. In the particular form shown, it appears a spring is disposed in the linking member 27 to effectuate a counter clockwise bias of the linking member 27 (relative to the orientation depicted in FIG. 3C).

On the far end of the handle end 20, proximate the opening from which the leg 28 is extendable, there is an actuation pawl 34. This actuation pawl 34 is L-shaped and pivotable about its bend at pin 36 (which is fixed relative to the handle end 20) which also engages the spring 15 to bias the handle strap 14 into the closed position. In the view illustrated in FIG. 3C, this actuation pawl 34 is biased in a clockwise direction using another spring, although other biasing members could be utilized. When biased into position, the actuation pawl 36 has a first segment 38 that extends up toward the opening 30 for engagement with the leg 28 and a second segment 40 spaced approximately 90 degrees from the first segment 38 that extends in a direction back toward the base end 18 of the handle strap 14.

This second segment 40 is arranged to engage a latch cable release cam 42 when the handle strap 14 is opened or actuated and the handle end 20 is moved. If this second end 40 of the actuation pawl 34 applies a force above a threshold force to the latch cable release cam 42, the latch cable release cam 42 will rotate, ultimately resulting in the release of the door latch (not shown).

However, unless the handle grip 24 is actuated and the leg 28 or blocking link is extended, the actuation pawl 34 will rotate when the handle strap 14 is pulled because the resistive force on the second segment 40 of the actuation pawl 34 will exceed the bias force of the actuation pawl 34. Only when the handle grip 24 is first pulled will the leg 28 or blocking link be extended and inhibit the rotation of the actuation pawl 34 by engagement with the first segment of the actuation pawl 34. With the leg 28 extended and the actuation pawl 34 unable to rotate, the opening of the handle strap 14 will move the actuation pawl 34 into engagement with the latch cable release cam 42 and force the latch cable release cam 42 to rotate, which opens the door.

FIGS. 5A through 5C and FIGS. 6A through 6C illustrate the difference between actuation of the handle strap 14 when the handle grip 24 is depressed or actuated and when it is not, respectively.

Figure 5A:
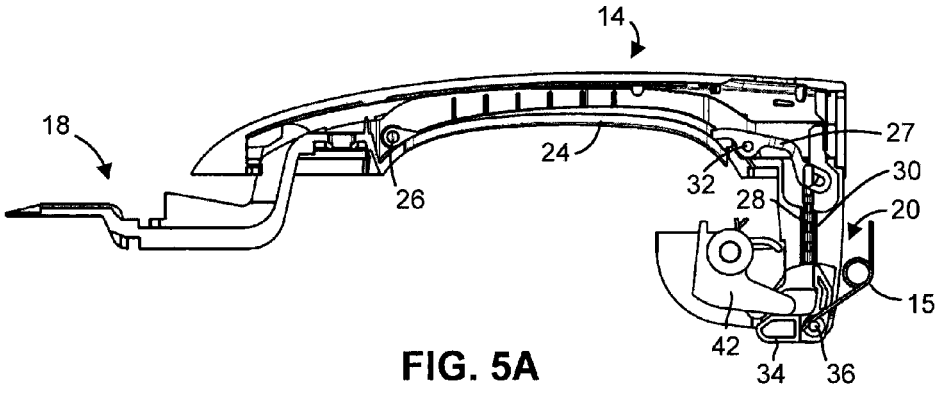
FIGS. 5A through 5C illustrate stepwise how the handle assembly is made to actuate a cable release cam when the handle grip is depressed and the handle pulled.
Figure 5B:
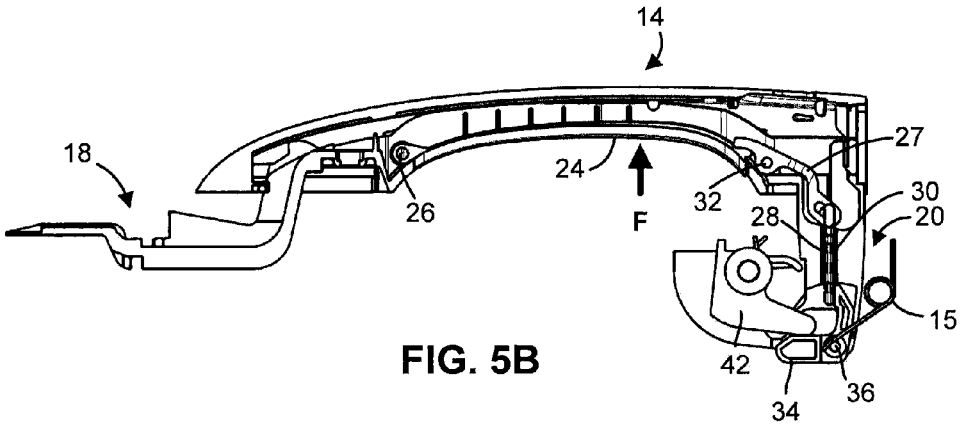
Figure 5C:
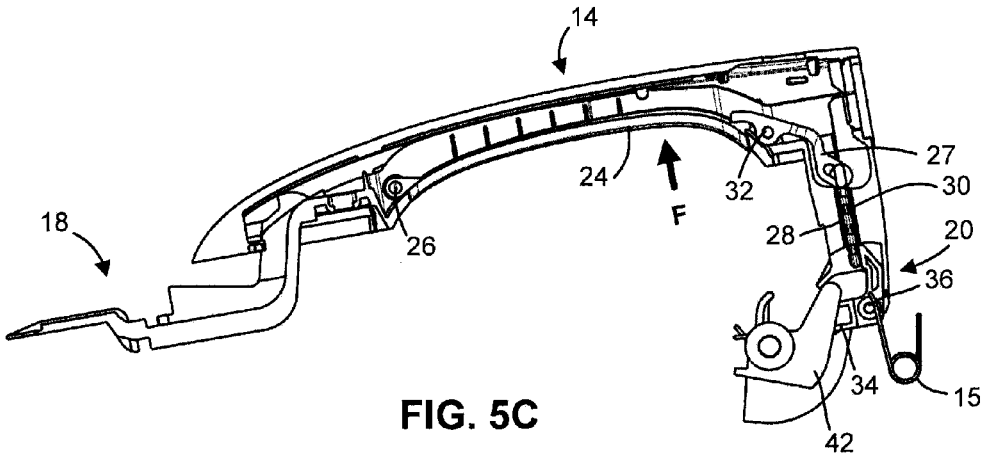

FIG. 5A illustrates a portion of the handle assembly 10 when the handle strap 14 is closed and the handle grip 24 is biased into the unactuated position. FIG. 5B illustrates the application of a force F to actuate the handle grip 24 thereby effectuating the extension of the leg 28 to a position in which it may engage with the actuation pawl 34. Then, in FIG. 5C, the handle strap 14 is rotated out from the door 12 while the handle grip 24 remains actuated. This causes the second segment 40 of the actuation pawl 34 to be forced into engagement with the latch cable release cam 42 and for the latch cable release cam 42 to rotate (which will release the door latch).

Figure 6A:
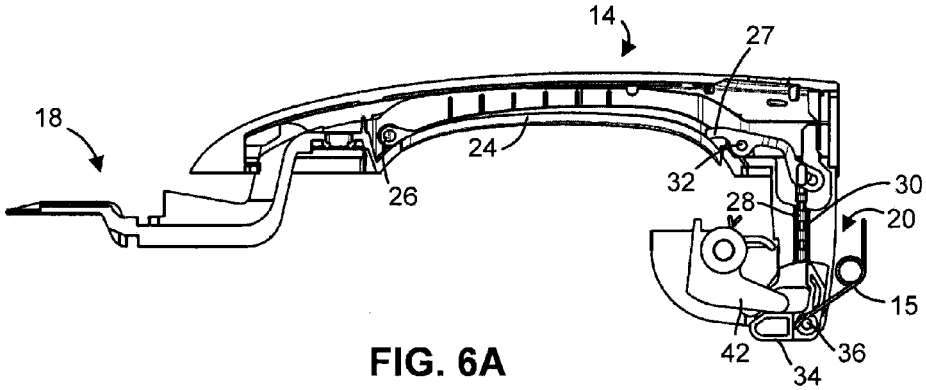
FIGS. 6A through 6C illustrate stepwise how, when the handle grip is not depressed and the handle is moved, the cable release cam is not actuated.
Figure 6B:
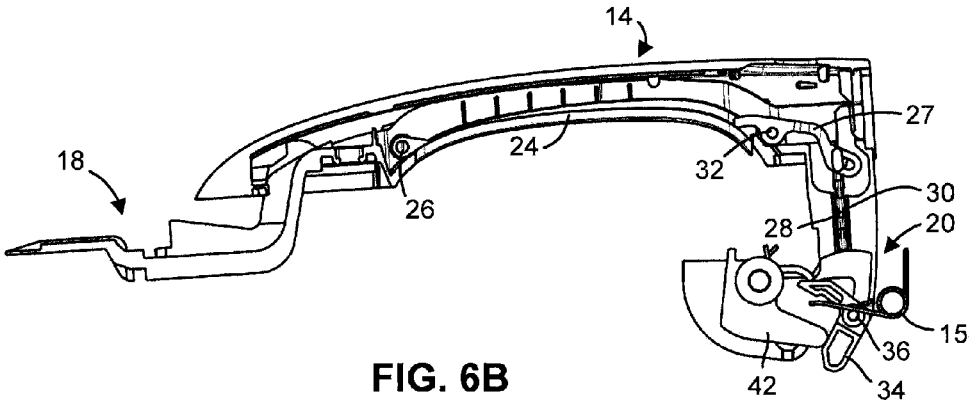
Figure 6C:
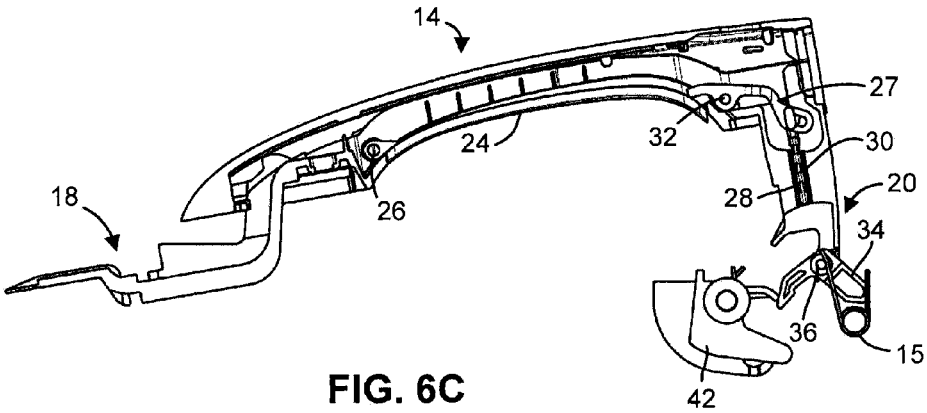

In contrast, FIGS. 6A through 6C depict an arrangement of steps in which the handle grip 24 is not actuated before the handle strap 14 is opened. FIG. 6A is similar to FIG. 5A in which the handle assembly 10 is closed and all parts are biased to their unactuated positions. Then in FIGS. 6B and 6C, the handle strap 14 is opened without first depressing the handle grip 24. Because the leg 28 or blocking link was not extended and engaging the first segment 40, the actuation pawl 34 begins rotating as it engages the latch cable release cam 42. Rather than effectuate the rotation of the latch cable release cam 42, the movement of the handle strap 14 simply moves the actuation pawl 34 past the latch cable release cam 42 as the actuation pawl 34 rotates to avoid actuation of the latch cable release cam 42.

This described structure is beneficial in the event of a vehicle crash. Often inertia forces can cause a handle strap to move relative to the door and fixed base. In a typical handle assembly, this may mean that the latch mechanism is engaged causing the release of the door latch. Once the door latch is released, the door may swing open, particularly if the door is not locked. The described arrangement, however, separately requires the actuation of the handle grip 24 in order for the latch mechanism to be engaged. This means that by controlling the biasing forces on the handle strap 14 and the handle grip 24, in a crash event the handle strap 14 may be configured to move outward before the handle grip 24 is actuated under additional inertia forces. However, by the time the handle strap 14 is moved outward, the actuation pawl 34 has already passed the latch cable release cam 42, so the further actuation of the handle grip 24 and the leg 28 will not cause the door latch to release.

Moreover, the disclosed handle assembly can reduce the likelihood of release of the latch due to crash-induced door deformation. As the handle strap is uncoupled from the latch release, the forces imparted by deformation should not be sufficient to transfer load sufficient to cause latch activation. This is another non-user operated condition in which, without actuation of the handle grip, the handle strap will not be operably coupled to the door latch mechanism.

In addition to the coupling mechanism disclosed above, there are other alternative coupling mechanisms that can likewise be employed in order to achieve the same effect (i.e., only cause the latch to be released after the handle grip has been actuated, but not under the conditions of an accident or crash).

Figure 7A:
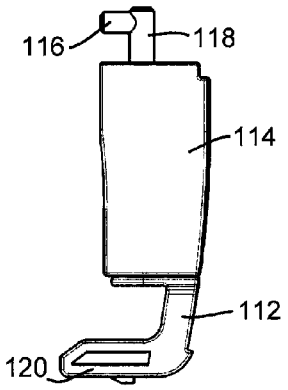
FIGS. 7A through 7F illustrate a release mechanism for a handle assembly with a rotating pawl.
Figure 7B:
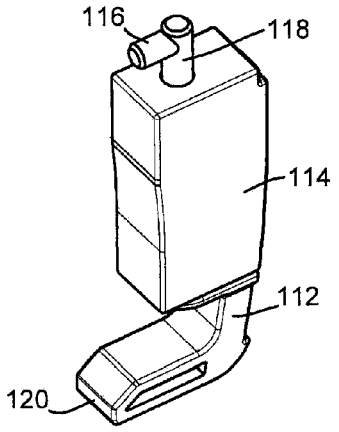

Turning now to FIGS. 7A through 7F, a portion of a first alternative selective coupling mechanism 110 is illustrated. In this alternative selective coupling mechanism 110, an actuation pawl 112 is rotatably disposed in a sub-housing 114. This sub-housing 114 may be part of and move with a handle strap, although this is not illustrated in the figures so as to provide a clear view of the parts that differ from the previously described handle assembly and to better highlight its mode of operation. As best illustrated in FIGS. 7A and 7B, a first portion of the actuation pawl 112 extends from a one end of the sub-housing 114 and includes a transverse stub 116 that extends from an axially-extending post 118. Although not illustrated, the transverse stub 116 is attached to a linkage, rocker, or the like that connects to the handle grip or pad (such as the grip 24 in the previous embodiment). A second portion of the actuation pawl 112 extends from the other end of the sub-housing 114 and includes a hook end 120 that is generally L-shaped. It is contemplated that these first and second portions may be unitary or, alternatively, there may be some mechanical linkages inside the sub-housing 114 which cause the actuation of the first portion to cause the rotation described below of the second portion having the hook end 120.

Figure 7C:
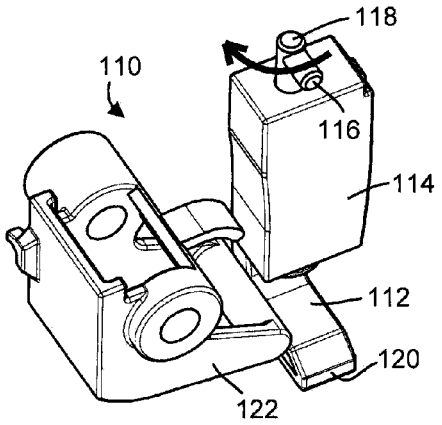
Figure 7D:
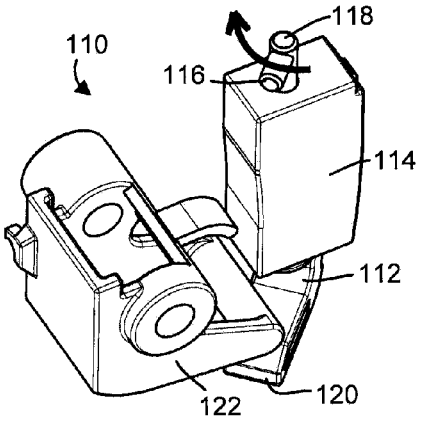
Figure 7E:
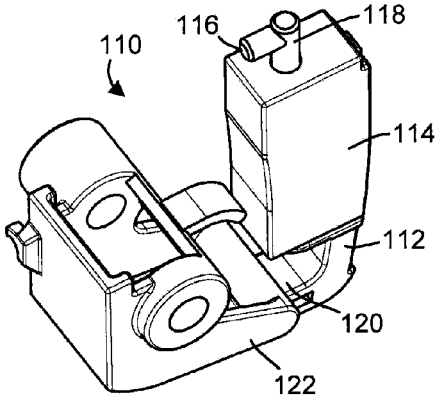

In FIGS. 7C through 7E, the actuation pawl 112 and sub-housing 114 are shown with a latch cable release cam 122 that performs a similar function to the latch cable release cam 42 described above. It can be seen that the axis of rotation of the actuation pawl 112 in this embodiment is generally perpendicular to the axis of rotation of the latch cable release cam 122 so that the hook end 120 of the actuation pawl 112 can be made to selectively engage latch cable release cam 122 when the sub-housing 114 and actuation pawl are moved together (such as by opening an attached handle strap) after the pawl 112 has been rotated into place for opening.

Looking specifically at FIG. 7C, the release mechanism is shown in the "rest" position in which the handle grip is not depressed and the handle strap has not been pulled. In this position, the hook end 120 of the actuation pawl 112 is rotated sufficiently away from the cable release cam 122 to ensure the two elements do not create a connection; in the figure it is shown as 90 degrees for illustrative purposes. This rotational placement may be established by a biasing mechanism, such as for example, a spring, inside the sub-housing 114. With the hook end 120 in this position, if the sub-housing 114 and the actuation pawl 112 were suddenly and abruptly moved as the result of inertial force or the like on the handle, then the actuation pawl 112 would move past the latch cable release cam 122 without engaging it and releasing the latch.

Figure 7F:
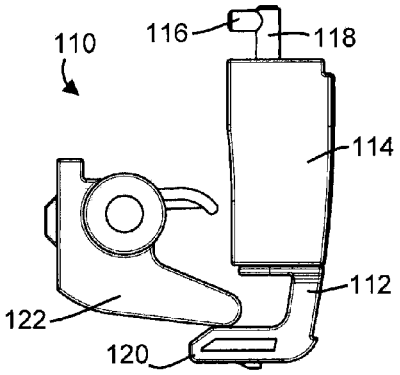

Looking now at FIG. 7D, the actuation pawl 112 is shown partially rotated after the handle grip has begun to be depressed and in an intermediately depressed position. During depression of the handle grip, the stub 116 on the axially-extending post 118 is engaged by a linkage, rocker, or so forth to cause to rotation of the actuation pawl 112. As a result of this engagement and rotation on the first portion, the hook end 120 of the actuation pawl 112 is rotated toward the latch cable release cam 122. The final position of the actuation pawl 112 is illustrated in FIGS. 7E and 7F, after the handle grip is completely depressed (which in one particular embodiment involves travel of the handle grip approximately 3 mm and before the handle strap is pulled). In this final position, the hook end 120 has swung the appropriate degrees to create the desired connection, shown here as 90 degrees from its original, biased position from which it was clear of the latch cable release cam 122 to its final position in which it is aligned with the latch cable release came 122. Once the hook end 120 has been actuated into place, if the sub-housing 114 and actuation pawl 112 are moved as the result of pulling the handle strap, then the hook end 120 of the actuation pawl 112 will engage the latch cable release cam 122 to effectuate release of the latch.

Again, because the actuation pawl 112 is biased, the actuation pawl 112 will rotate back to the position illustrated in FIG. 7C once the handle grip is released.

Turning now to FIG. 8A through 8F, yet another selective coupling mechanism 210 is illustrated. This selective coupling mechanism 210 includes a separable or floating pawl configuration in which a pawl segment 212 is selectively locked to a handle strap segment 214 (which may be attached to or integrally formed with the handle strap, such as the handle strap illustrated above).

Figure 8A:
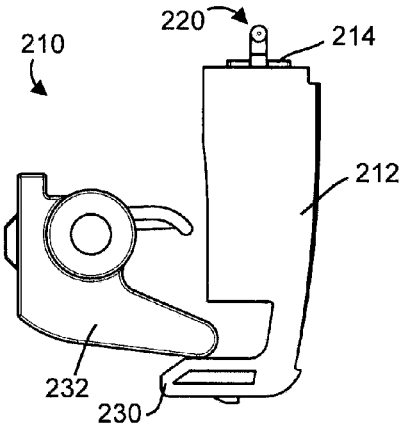
FIGS. 8A through 8F illustrate a release mechanism for a handle assembly in which a pin wedge selectively engages transverse pins to selectively lock or couple a portion of the handle strap segment to the pawl segment.
Figure 8B:
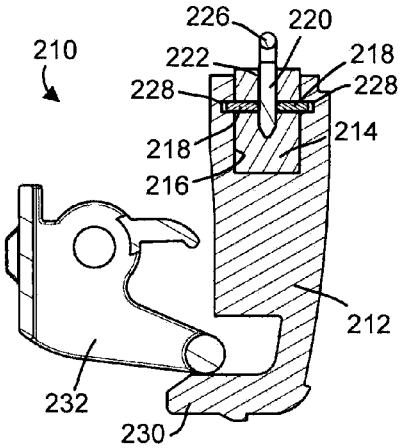
Figure 8C:
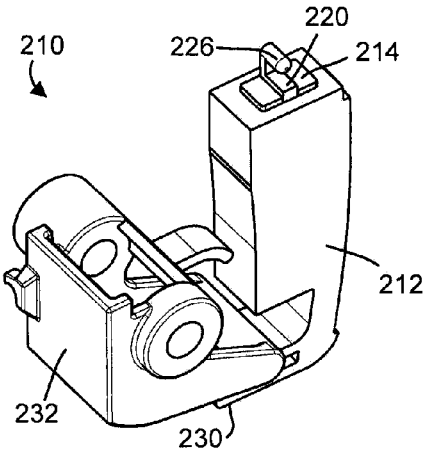
Figure 8D:
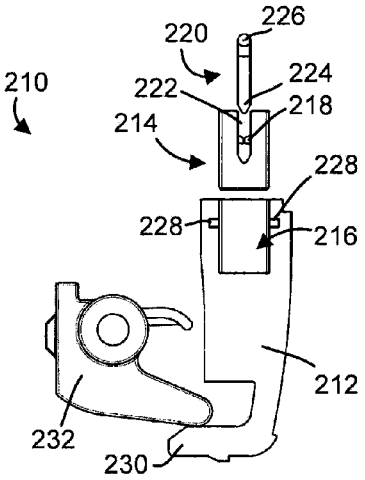

In the form illustrated, on one end, the pawl segment 212 includes a cavity 216 into which the handle strap segment 214 may be telescopically inserted. See, for example, the exploded view of FIG. 8D. The handle strap segment 214 includes a pair of transverse pins 218 which are, in the rest position, biased into the lateral sides of the strap segment 214. A pin wedge 220 is also insertable into a central opening 222 of the handle strap segment 214 along the telescopic axis, such that an angled surface on a tip 224 of the pin wedge 220 engages an angled surface of the transverse pins 218 in order to overcome the biasing force on the transverse pins 218 and to displace the transverse pins 218 laterally outward as best illustrated in FIG. 8B. The pin wedge 220 is attached to a linkage or the like by a tab 226 (disposed on the opposite end of the pin wedge 220 as the tip 224) which is attached to a handle grip or pad via a linkage, rocker, or the like.

When the strap segment 214 is received in cavity 216 of the pawl segment 212 and when the handle grip is depressed, the pin wedge 220 is inserted into central opening 222 of the handle strap segment 214. This insertion action thereby extends the pins 218 into receiving slots 228 in opposing sidewalls of the cavity 216 of the pawl segment 212, thereby locking the pawl segment 212 to the handle strap segment 214 as best illustrated in the cross-sectional view of FIG. 8B and as further depicted in FIGS. 8A, 8C, and 8F.

On the end of the pawl segment 212 opposite the cavity 216, the pawl segment 212 has a hook end 230. This hook end 230 is positioned for engagement with a latch cable release cam 232.

Figure 8E:
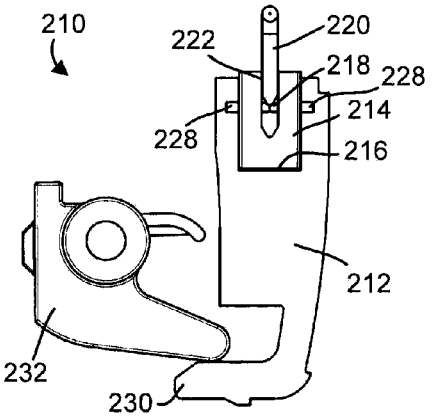
Figure 8F:
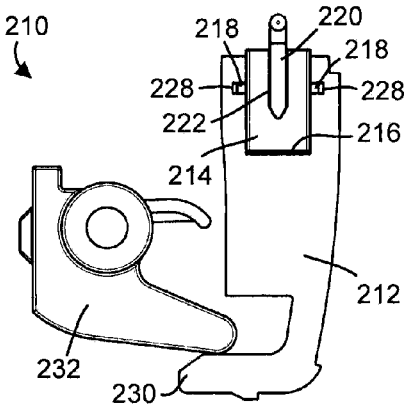

Now with reference to FIGS. 8E and 8F, the operation of the selective coupling mechanism 210 is described in greater detail. In FIG. 8E, the selective coupling mechanism 210 is illustrated in a "rest" position. In this position, the strap segment 214 is received in the cavity 216 of the pawl segment 216, but the pin wedge 220 is not fully inserted into the central opening 222 of the strap segment 214 (i.e., the handle grip or pad is not depressed so as to fully insert the pin wedge 220). As a result, the transverse pins 218 have not been extended out of the strap segment 214 and therefore the pawl segment 212 and the strap segment 214 are not locked together. In such a rest position, the movement of the connected handle strap (without the depression of the handle grip) causes the strap segment 214 to move relative to the pawl segment 212 without effectuating the movement of the pawl segment 212. Due to this de-coupling in the rest position, any movement of the strap segment 214 due to inertial forces from an accident or the like does not result in engagement of the pawl segment 212 with the latch cable release cam 232 in such a way as to release the latch.

However, once the pin wedge 220 is inserted into the strap segment 214 by the depression of a handle grip or pad, as illustrated in FIG. 8E, then the transverse pins 218 are extended into the receiving slots 228 of the cavity 216 of the pawl segment 212. After this locking engagement is initiated, then the further pulling of the handle strap will move the strap segment 214 and, accordingly, the pawl segment 212 to which it has become locked or coupled. This will cause the pawl segment 212 to move with the handle strap and cause the hook end 230 of the pawl segment 212 to engage the latch cable release cam 232 so as to release the latch.

Again, once the handle grip or pad is released, the pin wedge 220 is ejected, the transverse pins 218 return into the strap segment 214 and the pawl segment 212 and the strap segment 214 decouple from one another.

Figure 9A:
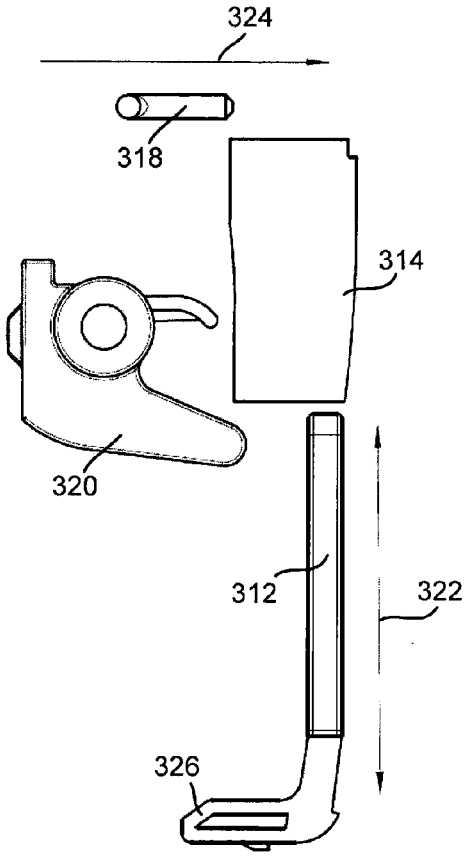
FIGS. 9A through 9C illustrate a release mechanism for a handle assembly in which a pin moves transversely to engage an aperture in a pawl and in which the pawl is movable in a direction generally perpendicular to the movement of the pin.
Figure 9B:
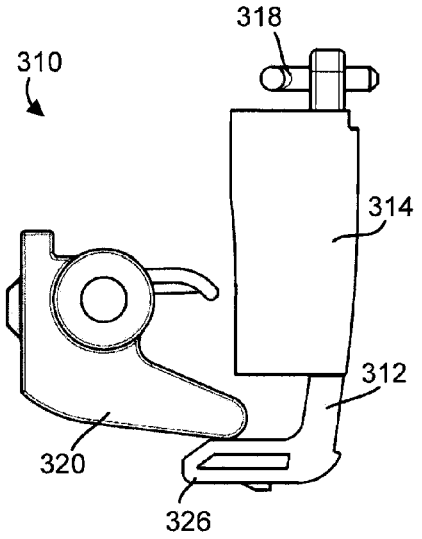
Figure 9C:
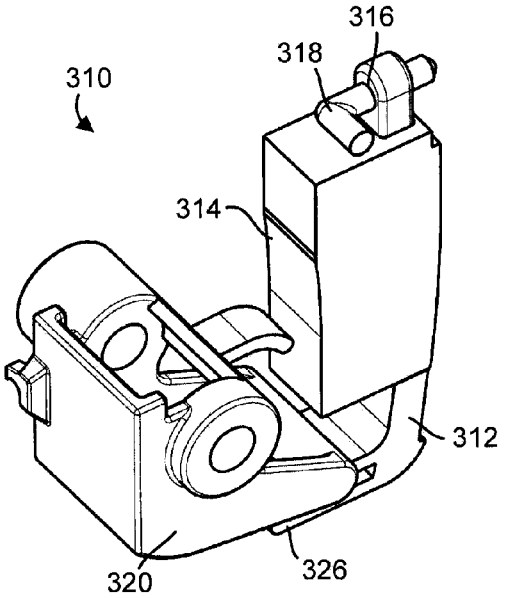

Turning now to FIGS. 9A through 9C, yet another configuration for a selective coupling mechanism 310 is illustrated. In this selective coupling mechanism 310, a pawl 312 is slidably received in through a sub-housing 314 (which may be a portion of the handle strap and move therewith). When the pawl 312 is received in the sub-housing 314, one end of the pawl 312 extends from a first side of the sub-housing 314. On this end, there is an aperture 316 formed in the pawl 312 (best shown in FIG. 9C) that extends transversely to the axis of insertion of the pawl 312 in the sub-housing 314. The aperture 316 is for selective engagement with a pin 318 that is, itself, actuatable in a direction perpendicular to the direction which the pawl 312 is slidingly received in the sub-housing 314. The other end of the pawl 312 extends from the second and opposite side of the sub-housing 314 and, on this end, there is a hook end 326 for selective engagement with a latch cable release cam 320.

The restricted directions of movement of the pawl 312 and the pin 318 are illustrated in FIG. 9A. The pawl 312 is movable in a first direction 322, over which the hook end 318 thereof can potentially engage and release the latch cable release cam 320. The pin 318 is movable in a second direction 324, that is perpendicular to the first direction 322, and over which the pin 318 can be inserted into or out of the aperture 316 of the pawl 312.

The pin 318 is attached to a linkage, rocker or the like that effectuates its movement based on a state of depression of a handle grip or pad. When the handle grip or pad is not depressed, the pin 318 is moved into a position in which the pin 318 does not interact with the aperture 316 on the pawl 312 such that the pawl 318 is not fixed relative to the sub-housing 314 and its attached handle strap. However, when the handle grip or pad is depressed, then the pin 318 is moved into interaction with the aperture 316 on the pawl 312 such that the pawl 312 moves with the sub-housing 314 (because the engagement with the pin 318 prevents the pawl 312 from substantially sliding relative to the sub-housing 314 when it moves).

Accordingly, the actuation of the handle pad or grip cause the pin 318 to enter or to be removed from the aperture 316 in the pawl 312 and thereby either couple or decouple the pawl 312 from the movement of the sub-housing 314 and its attached handle strap. When the two are coupled together, then the movement of the sub-housing 314 (by the further opening or pulling of the handle strap) will cause the hook end 318 of the pawl 312 to engage the latch cable release cam 320. When the pin 318 does not couple the pawl 312 to the sub-housing 314 and the handle strap, then an inertial load or force on the handle strap will not cause the pawl 312 to engage the latch cable release cam 320 so as to release the latch.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A handle assembly for preventing inadvertent opening of a motor vehicle door during a crash event, said handle assembly comprising:

a base fixedly secured to the motor vehicle door;

a handle strap extending between a handle end and a base end in which the handle strap is pivotal about the base end and in which the handle end extends through an aperture in the base;

a handle grip actuatable relative to the handle strap;

a blocking leg coupled to the handle grip and extending through the handle end of the handle strap;

an actuation pawl for selective engagement and actuation with a door latch release, the actuation pawl disposed proximate a free end of the leg and being rotatably attached to the handle end of the handle strap;

wherein, when the handle grip is actuated and then the handle strap is actuated away from the base, the leg is first positioned to engage the actuation pawl to prevent rotation of the actuation pawl so that upon actuation of the handle strap the actuation pawl engages and actuates the door latch release, and wherein when the handle grip is not actuated and then the handle strap is actuated away from the base, the leg is further configured to be positioned to allow rotation of the actuation pawl so that upon actuation of the handle strap the door latch release rotates the actuation pawl.

2. A handle assembly as set forth in claim 1, wherein, when the handle grip is not actuated, the actuation pawl is rotatable with minimal to no load and thus does not transmit appreciable force to the door latch release.

3. A handle assembly as set forth in claim 1, wherein, when the handle grip is actuated, the leg is rigidized and able to transmit unlatching force from the handle strap through the door latch assembly.

4. A handle assembly as set forth in claim 1, wherein the leg is directly attached to the handle grip.

5. A handle assembly as set forth in claim 1, wherein said leg is attached to the handle grip through a linking set of members.

6. A handle assembly for preventing inadvertent opening of a motor vehicle door during a crash event, said handle assembly comprising:

a base fixedly secured to the motor vehicle door;

a handle strap extending between a handle end and a base end in which the handle strap is pivotal about the base end and in which the handle end extends through an aperture in the base;

a handle grip actuatable relative to the handle strap;

an actuation pawl for selective engagement and actuation with a door latch release; and a selective coupling mechanism selectively coupling a pulling motion of the handle strap to the actuation pawl via a depression of the handle grip;

wherein, when the handle grip is actuated and then the handle strap is actuated away from the base, the actuation pawl translates with the handle strap to engage and actuate the door latch release and wherein, when the handle grip is not actuated and then the handle strap is actuated away from the base, the door latch release rotates the actuation pawl.

7. The handle assembly of claim 6, wherein the selective coupling mechanism selectively rotates a hook end of the actuation pawl along an axis of rotation that is generally parallel with a direction of travel of the actuation pawl when the handle strap is actuated and wherein the hook end is positionable to travel past the door latch release if the handle grip is not depressed and the handle strap is actuated away from the base or to engage the door latch release if the handle grip is depressed and the handle strap is actuated away from the base.

8. The handle assembly of claim 6, wherein the actuation pawl includes a segment that is selectively coupled to a segment fixed relative to the handle strap, wherein, when the handle grip is depressed, at least one pin in the segment fixed to the handle strap is caused to extend into a slot in the segment of the actuation pawl, thereby coupling the segments together.

9. The handle assembly of claim 6, wherein the actuation pawl is slidably received in a housing fixed relative to the handle strap and wherein the actuation pawl includes an aperture into which a transversely actuated pin is insertable via depression of the handle grip in order to couple the actuation pawl relative to the handle strap.

10. A handle assembly as set forth in claim 1, wherein the handle strap and the handle grip are configured such that, upon application of an external force to the handle assembly as the result of inertial forces or crash-induced door deformation, the handle strap is actuated before any actuation of the handle grip, thereby preventing an actuation of the door latch release by engagement with the actuation pawl.

11. A handle assembly as set forth in claim 1, wherein the actuation pawl rotates the door latch release.

12. A handle assembly as set forth in claim 5, wherein the linking set of members includes a linking member pivotably coupled to the handle strap for rotation about a pivot point, the handle grip configured to rotate the linking member about the pivot point.

13. The handle assembly of claim 6, wherein the actuation pawl is rotatable about the handle end of the handle strap.

14. The handle assembly of claim 6, wherein the actuation pawl rotates the door latch release.

15. The handle assembly of claim 6, wherein the selective coupling mechanism includes a linking member pivotably coupled to the handle strap for rotation about a pivot point, the handle grip configured to rotate the linking member about the pivot point.

16. A handle assembly for preventing inadvertent opening of a motor vehicle door during a crash event, said handle assembly comprising:

a base fixedly secured to the motor vehicle door;

a handle strap extending between a handle end and a base end in which the handle strap is pivotal about the base end and in which the handle end extends through an aperture in the base;

a handle grip actuatable relative to the handle strap;

a blocking leg extending through the handle end of the handle strap and coupled to the handle grip through a linking member pivotably coupled to the handle strap for rotation about a pivot point, the handle grip configured to rotate the linking member about the pivot point;

an actuation pawl for selective engagement and actuation with a door latch release, the actuation pawl disposed proximate a free end of the leg and being rotatably attached to the handle end of the handle strap;

wherein, when the handle grip is actuated and then the handle strap is actuated away from the base, the leg is first positioned to engage the actuation pawl to prevent rotation of the actuation pawl so that upon actuation of the handle strap the actuation pawl engages and actuates the door latch release.

17. A handle assembly for preventing inadvertent opening of a motor vehicle door during a crash event, said handle assembly comprising:

a base fixedly secured to the motor vehicle door;

a handle strap extending between a handle end and a base end in which the handle strap is pivotal about the base end and in which the handle end extends through an aperture in the base;

a handle grip actuatable relative to the handle strap;

an actuation pawl for selective engagement and actuation with a door latch release; and a linking member pivotably coupled to the handle strap for rotation about a pivot point and selectively coupling a pulling motion of the handle strap to the actuation pawl via a depression of the handle grip, the handle grip configured to rotate the linking member about the pivot point;

wherein, when the handle grip is actuated and then the handle strap is actuated away from the base, the actuation pawl translates with the handle strap to engage and actuate the door latch release and wherein, when the handle grip is not actuated and then the handle strap is actuated away from the base, the actuation pawl does not actuate the door latch release.

* * * * *